US005638655A

United States Patent [19]

Keck

[11] Patent Number: 5,638,655

[45] Date of Patent: Jun. 17, 1997

[54] CHIMNEY ANCHOR SYSTEM

[76] Inventor: Gerald W. Keck, 23107 Temescal Canyon Rd., Corona, Calif. 91719

[21] Appl. No.: 606,976

[22] Filed: Feb. 26, 1996

[51] Int. Cl.[6] ..... E04B 1/38

[52] U.S. Cl. ..... 52/713; 52/698; 52/167.1

[58] Field of Search ..... 52/698, 702, 712, 52/713, 167.1, 167.4

[56] References Cited

U.S. PATENT DOCUMENTS

| | | | |
|---|---|---|---|
| 5,048,243 | 9/1991 | Ward | 52/167.4 |
| 5,050,365 | 9/1991 | Edgar et al. | 52/712 X |
| 5,375,382 | 12/1994 | Weidlinger | 52/167.8 X |
| 5,400,555 | 3/1995 | Kantor | 52/712 X |
| 5,444,952 | 8/1995 | Jackson | 52/167.1 X |
| 5,456,047 | 10/1995 | Dorka | 52/167.1 X |

*Primary Examiner*—Carl D. Friedman
*Assistant Examiner*—Beth Aubrey
*Attorney, Agent, or Firm*—Edgar W. Averill, Jr.

[57] ABSTRACT

An improved chimney anchoring system to help support the chimney in the event of an earthquake. The chimney anchoring system uses several elongated steel straps which are affixed at one end to the chimney. At the other end, they are affixed to the frame of the structure in which the chimney is located. However, instead of being simply held by lag screws through holes in the strap into the wooden frame, the steel straps have elongated slots. In place of a conventional washer, a Belleville washer is used which is tightened to about a flat condition to exert a continuing force against the steel strap. Preferably a steel slip plate is located between the steel strap and the wooden frame member.

6 Claims, 2 Drawing Sheets

CHIMNEY ANCHOR SYSTEM

BACKGROUND OF THE INVENTION

The field of the invention is residential and commercial building including the use of masonry chimneys.

In the past, brick chimneys have not fared well during an earthquake. Because of the weight of such chimneys compared to a wooden frame, the chimneys tend to have more inertia during initial movement as compared to the frame. Thus, it is not uncommon for chimneys to break at the point at which they are attached to a wooden frame causing potential property damage as well as providing a safety hazard. The conventional method of securing a masonry chimney to a wooden frame utilizes four steel straps which are secured at one end to the chimney. These steel straps are also attached along their length to frame members of the wooden structure by lag screws passing through holes in the steel straps. The result is a secure and unmoving attachment at both ends of the steel straps and thus, during an earthquake, if the frame and the chimney tend to move at different times or rates, a large stress is placed on the masonry chimney.

The use of slotted bars to secure wall panels is shown in U.S. Pat. No. 5,048,243. Another use of a slotted securement means is shown in U.S. Pat. No. 5,375,382. There is not any suggestion, however, of any method for helping to preserve a masonry chimney during an earthquake.

BRIEF SUMMARY OF THE INVENTION

It is an object of the present invention to provide an improved chimney anchoring system which is capable of securing a masonry chimney to a wooden frame structure during an earthquake.

The present invention is for an improved chimney anchoring system and process utilizing a plurality of elongated steel straps affixed at one end to a masonry chimney to be secured and along the length of the steel straps to wooden frame members using lag screws. The steel straps, instead of having holes, utilize elongated slots formed parallel to the length of the steel straps. The lag screws are positioned at about the longitudinal center of the elongated slots through which they are placed. A Belleville washer is placed under the head of each lag screw and in contact with the steel strap. The Belleville washer is tightened to deform to provide a continuous force against the steel strap adjacent the elongated slot. In this way the steel strap is capable of a resisted movement with respect to the wooden frame member to which the lag screw is secured. Preferably a steel slip plate is inserted under the steel strap to more accurately provide a predetermined force for slipping. The present invention is also for the process of anchoring a supported object to a frame to provide some movement in the event of an earthquake. The process comprises the step of affixing one end of a steel strap to the supported object. Next, a Belleville washer is placed over a slot in the steel strap. A bolt is inserted through a hole in the Belleville washer and through the slot in the steel strap. Next, the bolt is tightened into the frame to deflect the Belleville washer. The process may further include the step of inserting a steel slip plate between the steel strap and the frame.

DESCRIPTION OF THE PREFERRED EMBODIMENTS

Figure 1:
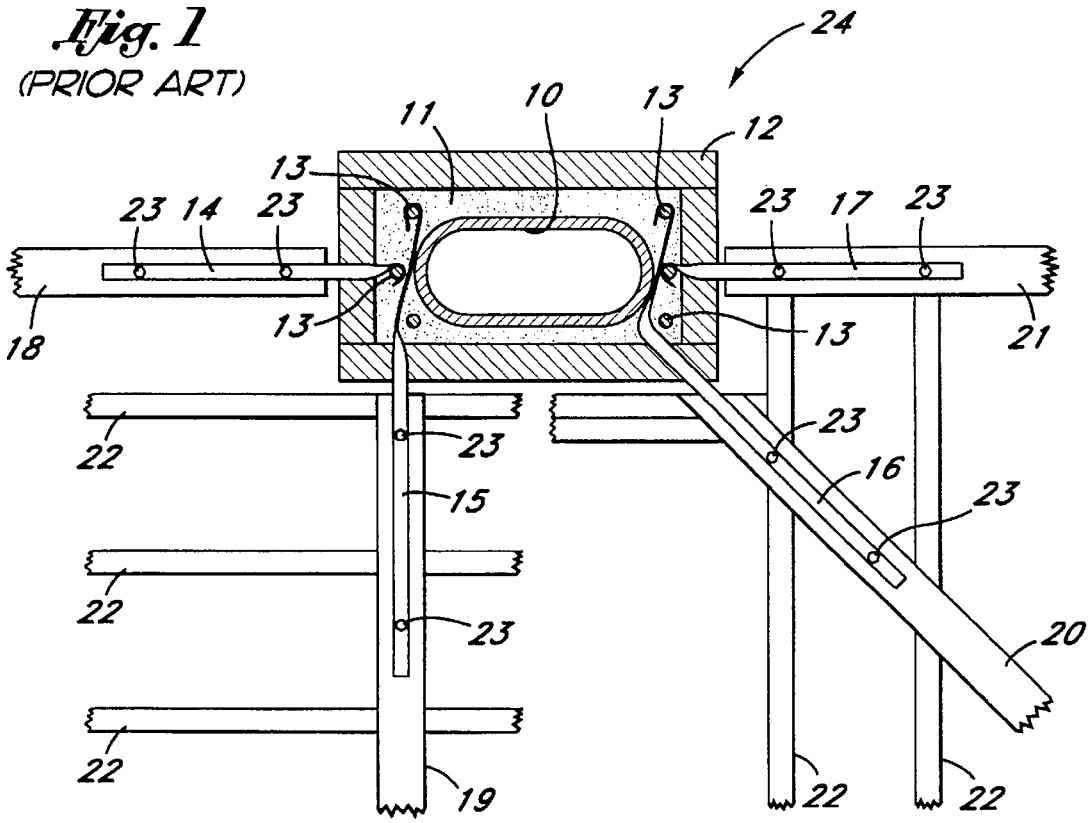
Fig. 1 (PRIOR ART)
FIG. 1 is a top view of a prior art chimney securement system showing a chimney secured to a wooden frame.

A prior art chimney securement assembly is shown in FIG. 1. The chimney tile 10 is surrounded by cement 11 which in turn is covered with a layer of masonry 12 such as brick. Six reinforcing bars 13 are held in cement 11. Four steel straps, 14, 15, 16 and 17 are shown affixed to frame members 18, 19, 20 and 21, respectively. These frame members are typically plates which are placed on top of frame elements 22. Each steel strap is secured around a reinforcing bar 13 and held securely in place by the cement 11. At the other end of each strap a pair of lag screws 23 are passed through holes in the steel plate. As a result, in the event of an earthquake, the masonry chimney 24 is rigidly secured to the wooden frame of the house and because of its different weight, during an earthquake will tend to move in a different manner than the wooden frame. Because the chimney is rigidly secured to the wooden frame, it is not uncommon for the chimney to break during an earthquake.

It has been found that fireplaces of the type referred to as a Rumford fireplace with a masonry chimney can provide a highly efficient source of heat as well as an aesthetically pleasing source of heat and light in a living area. In earthquake prone areas, however, it has been believed that the masonry chimney associated with such Rumford fireplace can provide a source of possible damage during an earthquake. Thus, the trend for new residential construction in earthquake prone areas is to build a chimney which has a central stovepipe supported in a wooden frame which is typically covered with stucco. Such chimneys are referred to as "zero clearance" chimneys. Such chimneys, however, have in turn provided a potential fire hazard as well as providing much lower heating efficiency than masonry chimneys. The heating efficiency of a zero clearance chimney is low because the air used to cool the metal chimney pipe does not get converted to heat within the structure. In addition, the useful life of metal chimney pipe is shorter than masonry chimneys particularly where corrosive conditions occur such as near the ocean. Metal chimney pipes have a relatively short life whereas masonry chimneys often outlast the rest of the house. Perhaps the most serious problem with zero clearance chimneys is the difficulty in repairing such chimneys. All of the components of a zero clearance fire place are a matched set and each manufacturer makes their pipe different from one year to the next. One cannot safely intermix parts from different manufacturers and many times the original manufacturer cannot be found or they no longer make the model which is desired to be repaired. This requires that the entire chimney be replaced with a new one which is usually more than the cost of the original chimney. Repairs to masonry chimneys usually consist of a little regrouting of brick joints, if anything. There is, therefore, a need for a better way to secure a masonry chimney to the wooden frame of a house or other structure.

Figure 2:
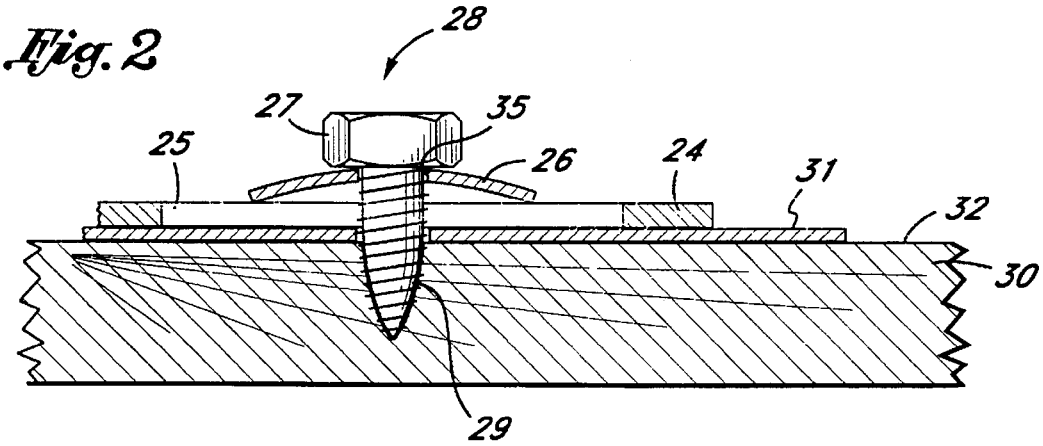
FIG. 2 is a side view partly in cross-section of a portion of a steel strap affixed to a frame member by a lag screw and Belleville washer.
Figure 3:
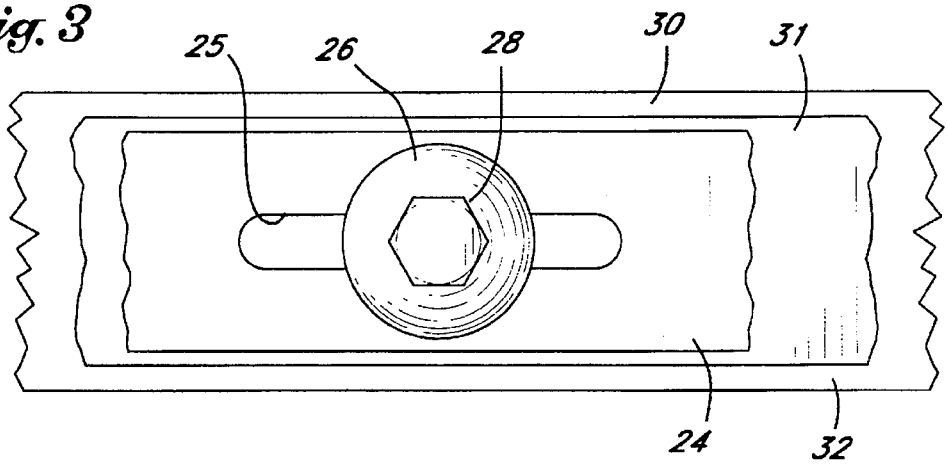
FIG. 3 is a top view of the assembly of FIG. 2.
Figure 4:
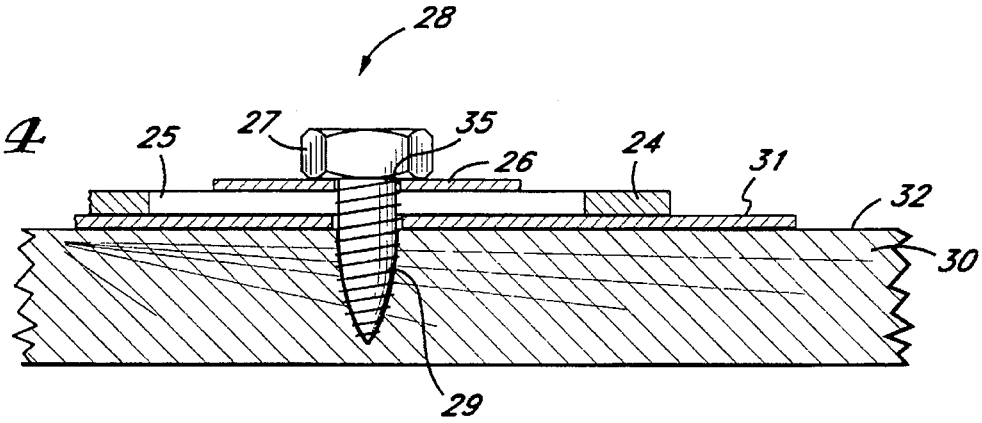
FIG. 4 is a side view of the assembly of FIG. 2 with the lag screw tightened.
Figure 5:
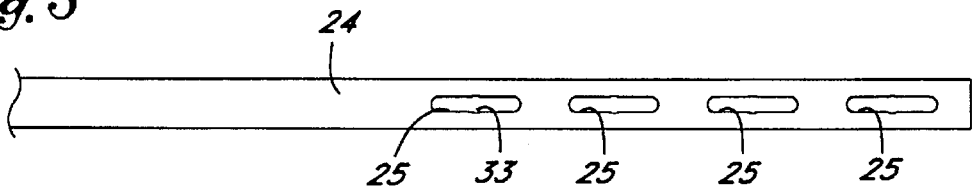
FIG. 5 is a top view of a portion of the steel strap of FIG. 2.
Figure 6:
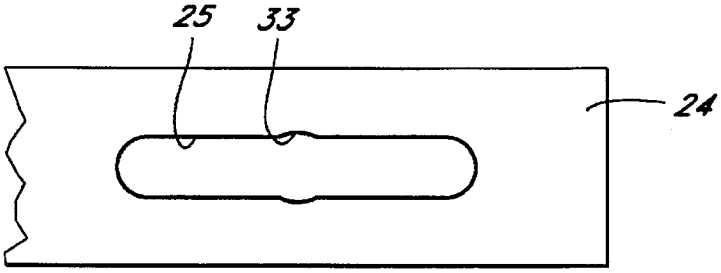
FIG. 6 is an enlarged top view of a slot in the steel strap of FIG. 2.

It has been found that by providing a controlled amount of slippage, a masonry chimney is capable of withstanding a major earthquake without damage. It is, however, important that the chimney be securely supported against high winds and other forces, and thus, a combination of secure support and permissible movement after a major force would be desirable. This combination of needs is met by the improved chimney anchoring system of the present invention. A steel strap 24 analogous to the steel straps 14, 15, 16 and 17 of FIG. 1 is shown in cross-sectional view in FIG. 2. Steel strap 24 differs from steel straps 14, 15, 16 and 17, however, in that it has a plurality of elongated slots 25 in place of small circular holes which are present in the prior art steel straps. Thus, as shown in FIG. 5, steel strap 24 has a plurality of elongated slots 25. A Belleville washer 26 is shown in an untightened configuration in FIG. 2 and is placed under the head 27 of lag screw 28. Lag screw 28 has a threaded shank 29 which is screwed into wooden frame member 30. A steel slip plate 31 is preferably placed under strap 24 and over the top 32 of wooden frame member 30. The assembly of FIG. 2 is shown in top view in FIG. 3 and in a tightened configuration in FIG. 4. The Belleville washer 26 is preferably tightened and deformed until it is about flat wherein it exerts a continuous pressure between the head 27 of lag screw 28. Also as shown best in FIG. 6, it is preferred that a small enlargement 33 be formed in the center of each slot 25 to assist in centering the lag screw 28 in slot 25.

The process for anchoring a supported object to a frame utilizes the step of affixing one end of a steel strap 24 to the object to be supported. Next, a Belleville washer 26 is placed over a slot 25 in a steel strap 24. Next, a lag screw 28 is placed through the hole 35 in Belleville washer 26. Next, the lag screw 28 is tightened to deflect the Belleville washer to a desirable degree and preferably to about a flat configuration. Preferably a steel slip plate 31 is placed between the frame and the steel strap.

The result of the use of the anchoring system of the present invention is to permit the use of a masonry chimney in an earthquake environment. The provision of some limited movement between the steel straps and the frame eliminates the major stress on the masonry chimney during an earthquake and permits the homeowner to have the advantages of a masonry chimney, including the attractive appearance, without creating a safety hazard.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An improved chimney anchoring system utilizing a plurality of elongated steel straps affixed at one end to a chimney to be secured and along the length of said steel straps to wooden frame members using lag screws placed through holes in the steel straps wherein the improvement comprises:

elongated slots formed in the steel straps in place of holes, said elongated slots being parallel to the elongated steel straps;

each lag screw is positioned in an elongated slot through which it is placed; and a Belleville washer under a head of each lag screw and in contact with the steel strap, the Belleville washer being tightened to deform the Belleville washer and press it against the steel strip.

2. The improved chimney anchoring system of claim 1 further including steel slip plates placed between the steel straps and the wooden frame members.

3. The improved chimney anchoring system of claim 1 wherein each elongated slot has an enlarged opening near the center thereof to assist in the positioning of the lag screws near the center of each slot.

4. The improved chimney anchoring system of claim 1 wherein each elongated slot is about two inches long.

5. A process for anchoring a supported object to a frame to provide some movement in the event of an earthquake, said process comprising the steps of:

affixing one end of a steel strap to the supported object;

placing a Belleville washer over a slot in said steel strap;

inserting a bolt through a hole in the Belleville washer and through the slot in the steel strap; and tightening the bolt into the frame to deflect the Belleville washer.

6. The process for anchoring a supported object of claim 5 further including the step of inserting a steel slip plate between the steel strap and the frame.

* * * * *